US012458079B2

(12) United States Patent
Webster

(10) Patent No.: US 12,458,079 B2
(45) Date of Patent: Nov. 4, 2025

(54) MULTIFUNCTIONAL LABOR SUPPORT GOWN

(71) Applicant: Melanie Webster, Lacey, WA (US)

(72) Inventor: Melanie Webster, Lacey, WA (US)

(73) Assignee: BIRTHINGS, LLC, Olympia, WA (US)

( * ) Notice: Subject to any disclaimer, the term of this patent is extended or adjusted under 35 U.S.C. 154(b) by 159 days.

(21) Appl. No.: 17/873,483

(22) Filed: Jul. 26, 2022

(65) Prior Publication Data

US 2023/0027051 A1 Jan. 26, 2023

Related U.S. Application Data

(60) Provisional application No. 63/225,774, filed on Jul. 26, 2021.

(51) Int. Cl.
*A41D 1/21* (2018.01)
*A41D 13/12* (2006.01)

(52) U.S. Cl.
CPC ..... *A41D 1/21* (2018.01); *A41D 13/1236* (2013.01); *A41D 2300/30* (2013.01)

(58) Field of Classification Search
CPC ..... A41D 13/1236; A41D 2300/30; A41D 2300/324; A41D 1/22; A41D 13/02;
(Continued)

(56) References Cited

U.S. PATENT DOCUMENTS 264,690 A * 9/1882 Hamilton ..... A41D 13/02 2/79
443,390 A * 12/1890 Caen ..... A41D 15/00 24/714.7

(Continued)

FOREIGN PATENT DOCUMENTS

CN 2414635 Y 1/2001
CN 212382108 U 1/2021

OTHER PUBLICATIONS

Detachable Skirt Two Piece Black Prom, Retrieved from Internet, Retrieved on Jun. 14, 2021 <URL: https://www.owxmall.com/?product_id=225966433_48>.

(Continued)

*Primary Examiner* — Heather Mangine
*Assistant Examiner* — Raquel M. Weis

(57) ABSTRACT

The multifunctional labor gown intents to provide users with a garment or a labor gown, that mothers can wear for labor and delivery. Targeted at hospital patients, the garment is versatile and adapts to the different stages of labor, medical interventions, and labor support techniques. To accomplish this, the garment includes multiple detachable fabric pieces, connected by a plurality of fasteners. Further, various layers of fabric panels are designed in an overlapping fashion to provide both coverage as well as access for medical intervention. Moreover, the garment is suitable for all births, whether at home, in a birthing center, or in a hospital. Additionally, the garment's unique design allows users to wear the garment in different ways. Thus, the multifunctional labor gown is a transforming labor gown that accommodates the needs and wants of the patient while meeting the requirements of the medical staff providing care.

14 Claims, 9 Drawing Sheets

(58) Field of Classification Search
CPC .... A41D 13/129; A41D 15/002; A41D 13/12; A41D 2400/70; A41D 7/00; A41D 15/005; A41D 11/00; A41D 1/215; A41D 1/21; A41D 1/14; A41C 3/08; A41B 9/08; A41B 13/06; A41B 13/005; A41B 13/00; A41B 1/22; A41B 1/06
USPC ..... 2/69, 71, 75, 104
See application file for complete search history.

(56) References Cited

U.S. PATENT DOCUMENTS 444,001 A * 1/1891 Lee ..... A41D 1/22 2/74
459,106 A * 9/1891 Fifield ..... A41D 15/00 2/139
471,478 A * 3/1892 Halford ..... A41D 11/00 2/75
488,887 A * 12/1892 Geldowsky ..... A41D 1/14 2/211
515,435 A * 2/1894 Loewenthal ..... A41B 13/00 2/80
558,331 A * 4/1896 Wolf ..... A41D 1/22 2/105
596,520 A * 1/1898 Lewis ..... A41D 1/14 2/71
601,556 A * 3/1898 Davis ..... A41D 7/00 76/5.1
695,496 A * 3/1902 Schermerhorn ... A41D 13/1236 2/114
715,248 A * 12/1902 Davis ..... A41D 11/00 2/70
723,063 A * 3/1903 Stillson ..... A41D 1/21 2/221
736,576 A * 8/1903 Camp ..... A41D 1/21 2/221
765,705 A * 7/1904 Kester ..... A41B 9/08 2/78.1
781,635 A * 2/1905 Critcher ..... A41D 1/14 2/407
784,918 A * 3/1905 Bunsick ..... A41B 13/00 2/80
818,351 A * 4/1906 Clark ..... A41D 13/1236 2/114
888,027 A * 5/1908 Morgan ..... A41D 1/22 2/105
905,021 A * 11/1908 Tartikoff ..... A41B 13/00 2/80
966,747 A * 8/1910 Holdgate ..... A41D 1/21 2/221
974,981 A * 11/1910 Lee ..... A41D 13/1236 2/114
1,068,976 A * 7/1913 Buckler ..... A41D 11/00 2/74
1,071,483 A * 8/1913 Vance ..... A41D 13/02 D2/743
1,073,833 A * 9/1913 Wyer ..... A41B 9/08 2/78.2
1,092,696 A * 4/1914 Curry ..... A41F 5/00 2/70
1,104,185 A * 7/1914 George ..... A41D 1/14 2/211
1,119,298 A * 12/1914 Malsin ..... A41D 1/21 2/76
1,122,737 A * 12/1914 Guinan ..... A41D 1/14 2/221
1,137,659 A * 4/1915 Oilar ..... A41D 15/002 2/78.1
1,138,468 A * 5/1915 Goldberg ..... A41D 1/22 2/72
1,145,855 A * 7/1915 Wise ..... A41D 13/02 2/79
1,174,316 A * 3/1916 Hartmann ..... A41D 1/21 2/76
1,183,511 A * 5/1916 Adams ..... A41D 13/02 2/70
1,208,133 A * 12/1916 Gaines ..... A41D 1/21 2/325
1,211,954 A * 1/1917 Metzger ..... A41D 11/00 D2/776
1,218,501 A * 3/1917 Whittingham ..... A41D 1/22 D2/757
1,283,643 A * 11/1918 Borgenicht ..... A41D 11/00 D2/776
1,285,444 A * 11/1918 Sollen ..... A41D 13/02 2/70
1,298,043 A * 3/1919 Hollander ..... A41D 15/00 2/70
1,311,600 A * 7/1919 Fiore ..... A41B 13/00 D2/776
1,331,799 A * 2/1920 Borgenicht ..... A41D 11/00 2/75
1,354,967 A * 10/1920 Goldberger ..... A41D 11/00 2/70
1,357,828 A * 11/1920 Goldberg ..... A41D 1/21 2/221
1,371,307 A * 3/1921 Hertz ..... A41D 1/14 2/211
1,372,977 A * 3/1921 Prokesch ..... A41D 1/21 2/76
1,405,694 A * 2/1922 Talianoff ..... A41D 11/00 D2/776
1,407,319 A * 2/1922 Borgenicht ..... A41D 11/00 2/71
1,418,281 A * 6/1922 Bornstein ..... A41D 11/00 2/72
1,420,176 A * 6/1922 Ballin ..... A41D 11/00 2/80
1,440,241 A * 12/1922 Pollack ..... A41D 13/02 2/80
1,444,291 A * 2/1923 Wheeler ..... A41D 15/00 2/71
1,458,889 A * 6/1923 Lang ..... A41D 11/00 2/71
1,476,831 A * 12/1923 Pease ..... A41D 11/00 D2/737
1,489,046 A * 4/1924 Thompson ..... A41B 9/08 2/269
1,489,904 A * 4/1924 Sobelman ..... A41D 11/00 2/106
1,530,504 A * 3/1925 Lenkowsky ..... A41D 1/14 2/211
1,546,428 A * 7/1925 Anderson ..... A41D 13/02 2/266
1,611,420 A * 12/1926 Cuddy ..... A41D 13/02 2/70
1,748,890 A * 2/1930 Martin ..... A41D 15/002 2/85
1,766,272 A * 6/1930 Vallier ..... A41B 9/06 2/114
1,784,369 A * 12/1930 Lowenbaum ..... A41D 1/22 2/72
1,808,614 A * 6/1931 Stein ..... A41B 9/08 D2/714
1,823,257 A * 9/1931 Cooper ..... A41D 1/22 2/76
1,840,888 A * 1/1932 Dooley ..... A41B 13/06 2/75
1,961,607 A * 6/1934 Forsch ..... A41B 13/04 2/75
1,972,795 A * 9/1934 Rieffannacht ..... A41D 7/00 2/71
1,998,051 A * 4/1935 Gerber ..... A41D 13/1236 2/114
2,016,664 A * 10/1935 Brewster ..... A41B 13/00 2/112
2,019,996 A * 11/1935 Roth ..... A41C 1/06 2/70

(56) References Cited

U.S. PATENT DOCUMENTS 2,046,350 A * 7/1936 Victorius ..... A41D 1/22 2/88
2,075,414 A * 3/1937 Wheeler ..... A41D 11/00 2/70
2,104,487 A * 1/1938 Kessler ..... A41B 1/06 2/70
2,109,867 A * 3/1938 Pedlar ..... A41D 1/22 2/73
2,115,833 A * 5/1938 Watinsky ..... A41D 7/00 D2/735
2,130,690 A * 9/1938 Lemoine ..... A41D 13/02 2/70
2,141,814 A * 12/1938 Frankfurt ..... A41D 1/21 2/76
2,148,344 A * 2/1939 Freedman ..... A41D 1/22 2/70
2,211,100 A * 8/1940 Cohen ..... A41D 15/00 2/70
2,260,168 A * 10/1941 Costanza ..... A41D 1/21 2/76
2,274,382 A * 2/1942 Richman ..... A41C 3/08 2/73
2,290,638 A * 7/1942 Englander ..... A41D 15/002 2/70
2,303,536 A * 12/1942 Freidman ..... A41D 1/22 2/93
2,313,399 A * 3/1943 Smink ..... A41D 1/21 2/211
2,320,783 A * 6/1943 Lee ..... A41D 15/002 2/94
2,344,462 A * 3/1944 Koret ..... A41D 1/14 2/221
2,354,815 A * 8/1944 Kay ..... A41D 1/14 2/218
2,391,770 A * 12/1945 Cangelose ..... A41B 9/08 D2/722
2,398,538 A * 4/1946 Koret ..... A41D 1/14 2/221
2,410,374 A * 10/1946 Wiese ..... A41B 13/00 604/388
2,413,906 A * 1/1947 Bono ..... A41D 1/14 2/221
2,440,752 A * 5/1948 Mathews ..... A41D 11/00 2/70
2,445,096 A * 7/1948 Whisnant ..... A41D 1/14 D2/742
2,470,031 A * 5/1949 Harris ..... A41D 1/22 2/217
2,471,086 A * 5/1949 Ackerman ..... A41D 11/00 235/131 R
2,492,396 A * 12/1949 Perlitch ..... A41B 9/06 2/76
2,513,065 A * 6/1950 Stagg ..... A41D 3/04 2/87
2,514,613 A * 7/1950 Thurston ..... A41D 1/14 2/211
2,515,082 A * 7/1950 Evans ..... A41D 1/22 D2/757
2,521,020 A * 9/1950 Prescott ..... A41D 11/00 2/70
2,528,340 A * 10/1950 Coven ..... A41D 13/1236 2/114
2,555,839 A * 6/1951 Abdell ..... A41F 9/025 2/221
2,559,953 A * 7/1951 Evans ..... A41D 1/00 D2/757
2,598,759 A * 6/1952 Calde ..... A41D 1/22 2/70
2,611,131 A * 9/1952 Heeter ..... A41B 13/00 2/69.5
2,612,643 A * 10/1952 Perry ..... A41D 1/00 24/388
2,622,247 A * 12/1952 Strauch ..... A41D 5/00 2/70
2,652,057 A * 9/1953 Siegel ..... A41B 13/00 604/397
2,703,885 A * 3/1955 Davis ..... A41C 3/00 450/82
2,729,822 A * 1/1956 Arkin ..... A41D 1/22 2/265
2,803,823 A * 8/1957 Broadwin ..... A41D 7/00 450/11
2,849,716 A * 9/1958 Kerson ..... A41D 15/00 2/70
2,880,731 A * 4/1959 Kendall ..... A41C 3/08 2/73
2,899,962 A * 8/1959 Entringer ..... A41B 9/08 450/95
2,912,698 A * 11/1959 Greenblatt ..... A41D 15/005 2/211
2,917,750 A * 12/1959 Goldring ..... A41D 1/21 2/221
2,929,072 A * 3/1960 Heilbronner ..... A41B 13/00 D2/714
3,002,193 A * 10/1961 Briskman ..... A41D 1/00 2/72
3,064,265 A * 11/1962 Bridgewaters ..... A41D 15/002 D2/776
3,106,717 A * 10/1963 Cuvin ..... A41D 1/21 2/76
3,185,156 A * 5/1965 Steinberger ..... A41C 1/06 450/14
3,327,714 A * 6/1967 Steinberger ..... A41C 3/08 2/73
3,961,376 A * 6/1976 Howell ..... A41D 15/00 2/71
3,965,487 A * 6/1976 Mazur ..... A41D 11/00 2/84
4,154,249 A * 5/1979 Darring ..... A41C 1/06 450/14
4,656,669 A * 4/1987 Beard ..... A41D 7/00 2/912
4,811,429 A * 3/1989 Perez ..... A41B 13/06 2/70
4,815,145 A * 3/1989 Chow ..... A41D 7/00 2/72
5,062,159 A * 11/1991 Jakub ..... A41D 13/1236 2/70
5,173,965 A * 12/1992 Panner ..... A41D 15/002 2/244
5,226,193 A * 7/1993 Chen ..... A47G 9/083 2/69.5
5,327,586 A * 7/1994 Evans ..... A41D 1/14 2/48
5,440,763 A * 8/1995 Shah ..... A41D 13/1236 2/912
5,628,064 A * 5/1997 Chung ..... A41D 15/00 2/119
6,016,569 A * 1/2000 Everett ..... A41D 7/00 2/408
6,108,815 A * 8/2000 Majerfeld ..... A41D 13/02 2/71
6,185,745 B1 * 2/2001 Alger ..... A41B 1/06 24/304
6,223,352 B1 * 5/2001 Watlington ..... A41D 15/002 2/83
6,282,717 B1 * 9/2001 Ng ..... A41D 15/00 2/70
6,374,415 B1 * 4/2002 Lenart ..... A41D 13/1236 2/114
7,836,519 B2 * 11/2010 Zahler ..... A41D 13/002 2/96
8,051,496 B2 * 11/2011 Hersh ..... A41D 7/00 2/67
8,075,366 B1 * 12/2011 Jaksic ..... A41C 3/08 2/105
8,245,322 B1 * 8/2012 Bouza ..... A63B 21/4009 2/72

(56) References Cited

U.S. PATENT DOCUMENTS 8,365,313 B2 * 2/2013 Greenblat ..... A41D 1/22 2/69
8,522,362 B1 * 9/2013 Stones ..... A41D 7/00 450/33
9,357,806 B2 * 6/2016 Terrell ..... A41D 13/129
9,364,035 B1 * 6/2016 Shachaf ..... A41D 15/00
9,731,152 B2 * 8/2017 Swartz, IV ..... A41D 13/00
10,092,045 B2 * 10/2018 Smith ..... A41D 15/00
10,779,584 B1 * 9/2020 Smith ..... A41D 1/14
2003/0126667 A1 * 7/2003 Braun ..... A41D 27/10 2/69
2006/0253953 A1 * 11/2006 Williams ..... A41D 13/1272 2/69
2007/0105481 A1 * 5/2007 Scholz ..... A41D 1/215 450/3
2007/0240248 A1 * 10/2007 Hodges ..... A41D 1/215 2/104
2007/0271675 A1 * 11/2007 Eraca ..... A41D 1/215 2/104
2008/0000004 A1 * 1/2008 Lucock ..... A41D 1/215 2/104
2008/0271222 A1 * 11/2008 Nienow ..... A47G 9/064 2/311
2009/0126072 A1 * 5/2009 Allen ..... A41D 7/00 2/82
2009/0320175 A1 * 12/2009 Shih ..... A41D 15/00 2/243.1
2010/0199399 A1 * 8/2010 Garza ..... A41D 15/002 2/24
2010/0199404 A1 * 8/2010 Garza ..... A41D 3/02 2/244
2011/0004982 A1 * 1/2011 Henningsen ..... A41D 13/02 2/243.1
2012/0096618 A1 * 4/2012 Mashkevich ..... A41D 7/008 2/69
2013/0065484 A1 * 3/2013 Ducoulombier ..... A41C 3/08 450/30
2013/0225043 A1 * 8/2013 Musarra-Leonard .... A41C 3/00 450/92
2014/0196188 A1 * 7/2014 Brady ..... A41D 15/00 2/67
2015/0007374 A1 * 1/2015 Larson ..... A41D 15/00 2/67
2015/0150317 A1 * 6/2015 Terrell ..... A41D 13/1245 2/114
2015/0173427 A1 * 6/2015 Sawyer ..... A41D 15/002 2/67
2015/0201686 A1 * 7/2015 Gauthier ..... A41D 15/00 2/69
2016/0037837 A1 * 2/2016 Ferrara ..... A41D 7/00 450/1
2016/0165974 A1 * 6/2016 Peterson ..... A41D 15/00 2/70
2016/0316835 A1 * 11/2016 Caufield ..... A41D 1/21
2017/0006939 A1 * 1/2017 Moctezuma ..... A41D 1/14
2017/0020455 A1 * 1/2017 Hou ..... A61B 5/024
2017/0164667 A1 * 6/2017 Street ..... A41D 7/00
2017/0325519 A1 * 11/2017 Willingham ..... A41D 7/00
2018/0027891 A1 * 2/2018 Thrane ..... A41D 27/08
2018/0035725 A1 * 2/2018 Carlton ..... A41C 3/02
2018/0168251 A1 * 6/2018 Loveland ..... A41D 1/14
2018/0177243 A1 * 6/2018 Hawkins ..... A41B 9/08
2018/0255853 A1 * 9/2018 Spathas ..... A41D 1/21
2018/0279698 A1 * 10/2018 Heimbigner ..... A41D 3/08
2019/0053554 A1 * 2/2019 Bryant ..... A41D 15/04
2019/0069617 A1 * 3/2019 Farrell ..... A41D 15/002
2019/0098966 A1 * 4/2019 Harris ..... A44B 19/32
2019/0239576 A1 * 8/2019 Harrison ..... A41D 13/129
2019/0239583 A1 * 8/2019 Bakkamanthala ..... A41D 27/24
2019/0343191 A1 * 11/2019 Kassel ..... A41B 13/00
2020/0093199 A1 * 3/2020 Fahey ..... A41D 15/00
2021/0045464 A1 * 2/2021 Green ..... A41D 1/02
2021/0076752 A1 * 3/2021 Ceraolo ..... A41D 15/00
2022/0330631 A1 * 10/2022 Heppard ..... A41D 27/205
2023/0027051 A1 * 1/2023 Webster ..... A41D 13/1236

OTHER PUBLICATIONS

Prom Dresses Formal Dresses Wedding Party Dresses Detachable Skirt, Retrieved from Internet, Retrieved on Jun. 14, 2021 <URL: https://www.larovias.com/products/prom-dresses-formal-dresses-wedding-party-dresses-detachable-skirt-lpd431>.

Advance Zip Front Bra B-DD, Retrieved from Internet, Retrieved on Jun. 14, 2021 <URL: https://athleta.gap.com/browse/product.do?pid=657888022>.

* cited by examiner

MULTIFUNCTIONAL LABOR SUPPORT GOWN

FIELD OF THE INVENTION

The present invention generally relates to a garment. More specifically, the present invention relates to a novel gown that provides cover for a hospital patient while offering easy access to the patient's body for the purpose of conducting medical procedures.

BACKGROUND OF THE INVENTION

A hospital gown, also known as a patient gown, exam gown, johnny shirt, or johnny gown, is a short-sleeved, thigh-length garment worn by patients in hospitals and other medical facilities. A hospital gown, sometimes called a johnny gown or johnny, is a long, loose piece of clothing (a short-sleeved, thigh-length garment) worn by patients in hospitals and other medical facilities. It can be used as clothing by bedridden patients. Generally, hospital gowns are made of fabric, and disposable hospital gowns may be made of paper or thin plastic. Healthcare workers may prefer thin hospital gowns, which are convenient when listening to the heart and lungs, and it is easier for nurses to give injections when a patient is wearing a gown rather than a normal clothing. Because hospital gowns are made thinner than regular clothing, patients are less likely to overheat. Patients admitted to the labor and delivery unit of a hospital are given a gown to wear. This gown is the same one used throughout the hospital, for every age group and sex, and is large and tentlike by virtue of being one-size-fits-most.

The hospital gown is uncomfortable, cumbersome, and unattractive and takes away patients' individuality and feeling of control, not least because the open back causes embarrassing exposure. Custom labor gowns are available in the marketplace to address this issue, but they do not meet the needs of hospital staff or provide versatility and unique functionality, so they are not a significant improvement over the gowns traditionally used in hospitals. Accordingly, there is a need to develop a gown to solve these problems. In other words, a novel gown for hospital patients is in demand.

The present invention is intended to address problems associated with and/or otherwise improve on conventional gowns through an innovative labor support gown that is convenient and effective for patients in hospitals while incorporating other problem-solving features. It is an objective of the present invention to provide a garment or a labor gown, that mothers can wear for labor and delivery. Targeted at hospital patients, it is versatile and adapts to the different stages of labor, medical interventions, and labor support techniques. To accomplish this, the present invention comprises multiple detachable fabric pieces, connected by a plurality of fasteners. Further, various layers of fabric panels are designed in an overlapping fashion to provide both coverage as well as access for medical intervention. Moreover, it is suitable for all births, whether at home, in a birthing center, or in a hospital. Furthermore, the present invention's unique design allows it to be worn in different ways, and it can transform to meet the demands of each stage of labor and medical intervention. Thus, the present invention is a transforming labor gown that accommodates the needs and wants of the patient while meeting the requirements of the medical staff providing care.

SUMMARY

The present invention provides a garment or a labor gown, that mothers can wear for labor and delivery. Targeted at hospital patients, the present invention is versatile and adapts to the different stages of labor, medical interventions, and labor support techniques. To accomplish this, the present invention comprises multiple detachable fabric pieces, connected by a plurality of fasteners. Further, various layers of fabric panels are designed in an overlapping fashion to provide both coverage as well as access for medical intervention. Moreover, the present invention is suitable for all births, whether at home, in a birthing center, or in a hospital. Additionally, the present invention's unique design allows it to be worn in different ways, and it can transform to meet the demands of each stage of labor and medical intervention. Thus, the present invention is a transforming labor gown that accommodates the needs and wants of the patient while meeting the requirements of the medical staff providing care.

DETAIL DESCRIPTIONS OF THE INVENTION

Figure 1:
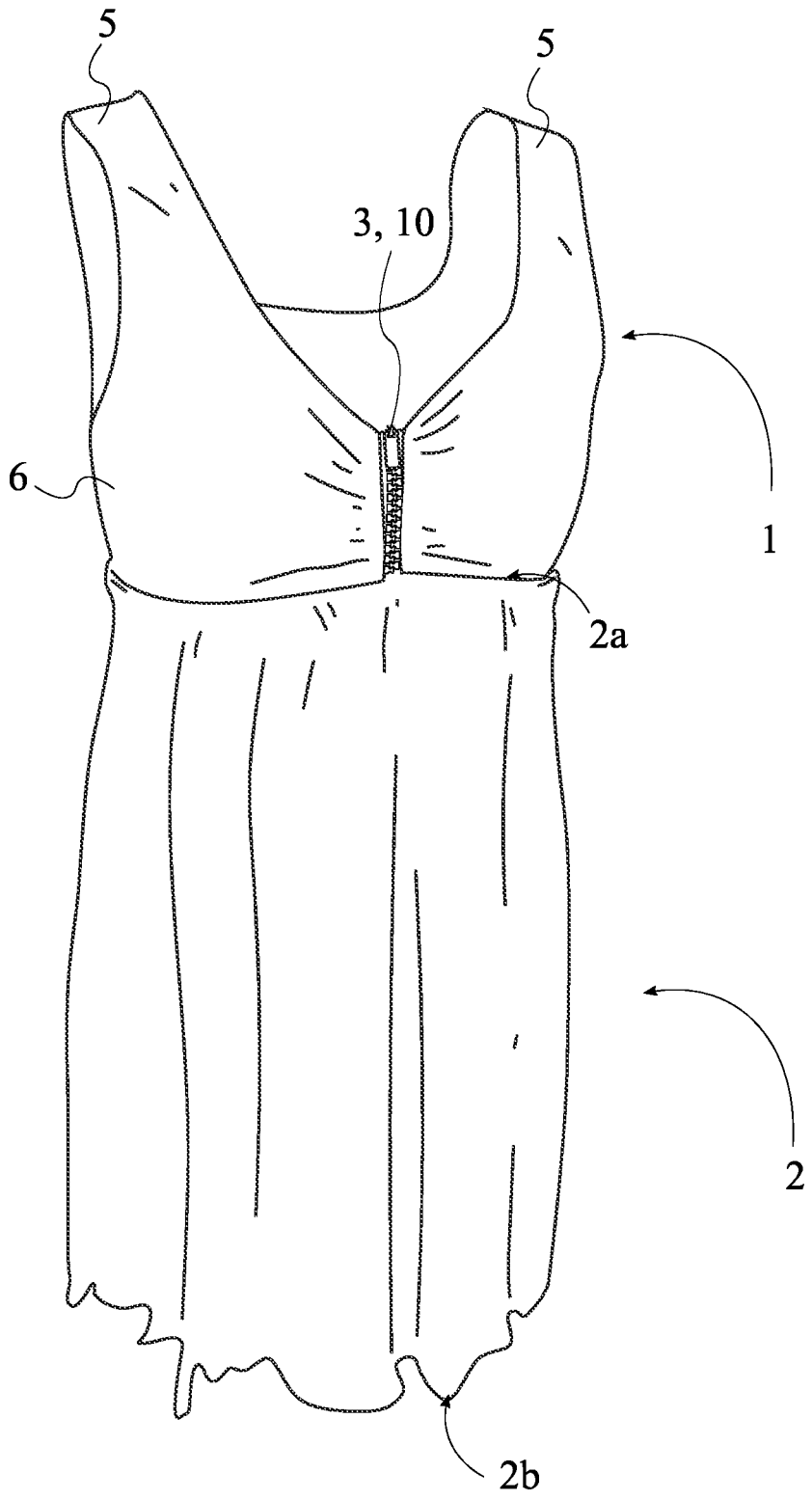
FIG. 1 is a top-front perspective view of the present invention.

All illustrations of the drawings are for the purpose of describing selected versions of the present invention and are not intended to limit the scope of the present invention. In reference to FIG. 1 through FIG. 9, the present invention is a multifunctional labor gown. It is an objective of the present invention to provide a garment or a labor gown, that mothers can wear for labor and delivery. Targeted at hospital patients, the present invention is versatile and adapts to the different stages of labor, medical interventions, and labor support techniques. To accomplish this, the present invention comprises multiple detachable fabric pieces, connected by a plurality of fasteners. Further, various layers of fabric panels are designed in an overlapping fashion to provide both coverage as well as access for medical intervention. Moreover, the present invention is suitable for all births, whether at home, in a birthing center, or in a hospital. Additionally, the present invention's unique design allows it to be worn in different ways, and it can transform to meet the demands of each stage of labor and medical intervention. Thus, the present invention is a transforming labor gown that accommodates the needs and wants of the patient while meeting the requirements of the medical staff providing care.

The following description is in reference to FIG. 1 through FIG. 9. According to a preferred embodiment, the present invention comprises a first piece 1, a second piece 2, a plurality of fasteners 3, and a plurality of strings 4. Preferably, the first piece 1 constitutes an upper part of the garment and the second piece 2 constitutes a lower part of the garment. In the preferred embodiment, the first piece 1 and the second piece 2 are made of fabric that may be soft, stretchy, and quick drying. Further, the fabric may be a double-brushed poly stretch jersey knit in multiple patterns and colors. In some other embodiments, the fabric's colors and patterns can be chosen to camouflage blood and body fluids associated with the birth process. Furthermore, unlike traditional hospital gowns, the present invention may be of multiple sizes, to provide a custom fit for the mother. However, the first piece 1 and the second piece 2 may comprise any material, color, shape, components, arrangement of components etc., as long as the intents of the present invention are not altered.

In the preferred embodiment, the first piece 1 comprises a plurality of shoulder straps 5 and a bodice 6. In other words, the top piece 1 of the garment comprises a comfortable bra portion with straps. The second piece 2 is designed to cover the lower portion of the patient's body from the waist down and includes wrap flaps with a front panel and a back panel. Accordingly, the second piece 2 comprises a plurality of overlapping panels 7, a first end 2*a* and a second end 2*b*. In other words, the bottom piece of the garment comprises a wrap model skirt portion made or two overlapping panels. Preferably, the first end 2*a* constitutes an upper end of the second piece 2, and the second end 2*b* constitutes the lower end of the second piece 2.

As seen in FIG. 1 through FIG. 9, the first piece 1 is detachably connected to the second piece 2, along the first end 2*a*. In other words, in the preferred embodiment, the first piece 1 and the second piece 2 may be connected together to make a single gown or a frock like garment and may be detached to two separate garment pieces as per the demand, convenience, or requirement of the user.

According to the preferred embodiment, the plurality of fasteners 3 comprises a first fastener 8, a second fastener 9, and a third fastener 10. In order to attach the first piece 1 to the second piece 2, the first fastener 8 is integrated between the first piece 1 and the second piece 2. As seen in FIG. 4 through FIG. 6 and FIG. 9, the first fastener 8 comprises a plurality of snap buttons distributed between terminal edges of the first piece 1 and the second piece 2. However, the first fastener 8 may comprise any other fastener, size, shape, location etc. that are known to one of ordinary skill in the art, as long as the intents of the present invention fulfilled. Examples of such fasteners include, but are not limited to zippers, hook and loop fasteners, hooks, buttons etc.

Figure 5:
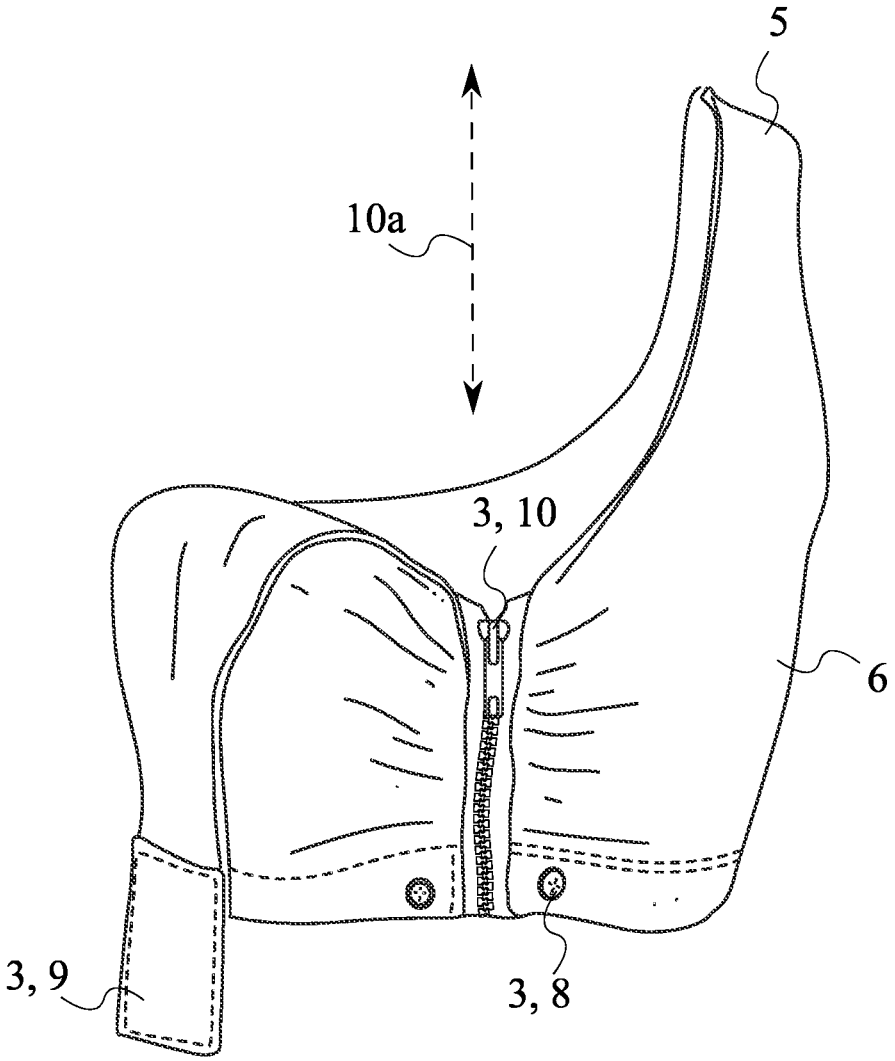
FIG. 5 is a top front perspective view of the first piece, wherein a second fastener is unfastened.
Figure 7:
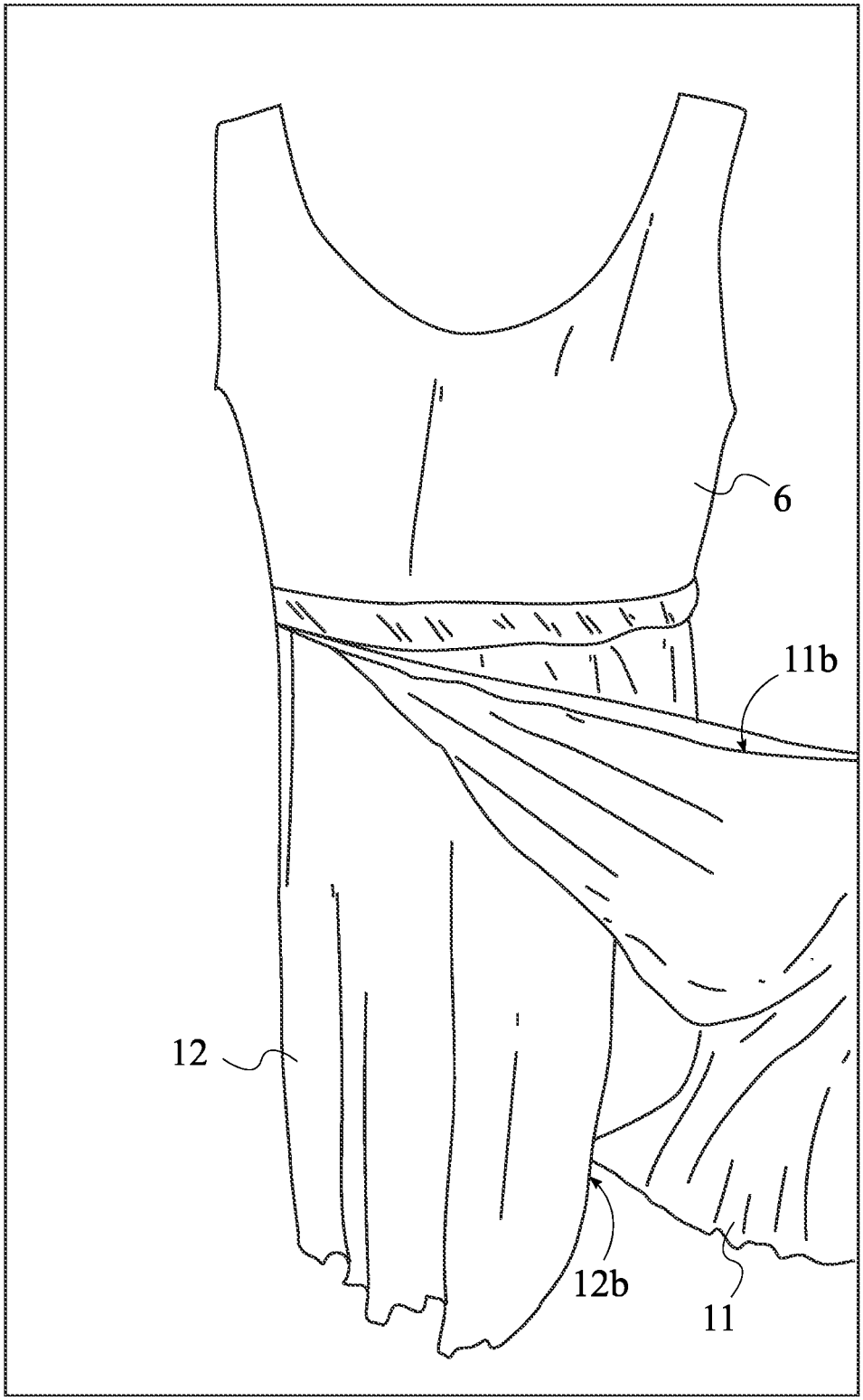
FIG. 7 is a rear perspective view of the present invention, wherein a first panel is raised to depict a second overlap of the second piece.
Figure 8:
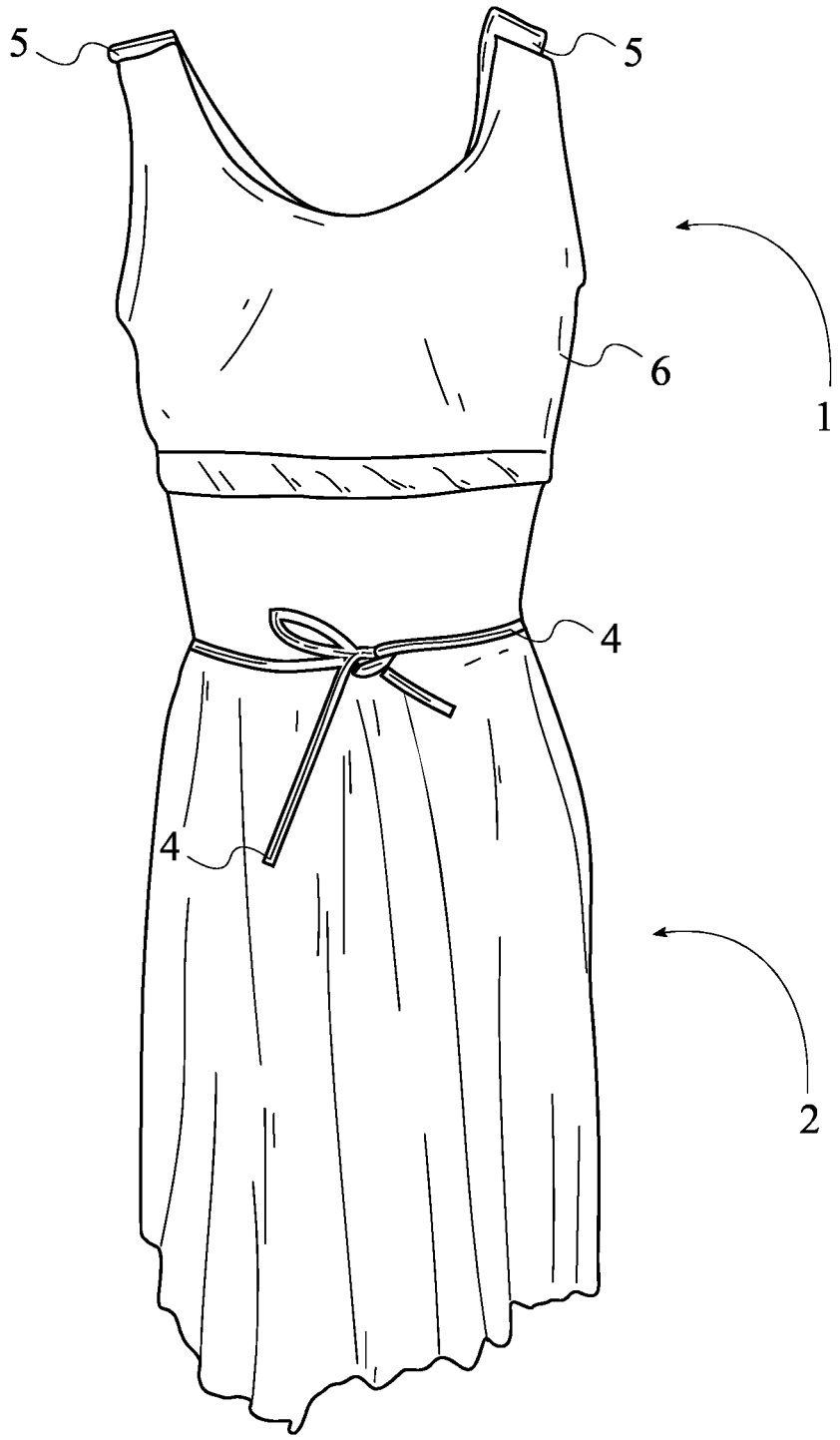
FIG. 8 is a rear elevational view, wherein the plurality of strings is tied around a first end of the second piece.

It is an objective of the present invention, to accommodate the needs and wants of the patient while meeting the requirements of the medical staff providing care. To that end, the second fastener 9 is integrated across the plurality of shoulder straps 5. This is so that, a fastener closure or the second fastener 9 (e.g., a hook-and-loop fastener) at the shoulder may accommodate IV tubing and allow quick and easy removal of the first piece 1 as needed. Thus, as seen in FIG. 5, the second fastener 9 may detach each of the plurality of shoulder straps 5 into a plurality of sections, according to the need and convenience of the user and the medical team. Further, the second fastener 9 allows for a strap long enough for the individual wearer to customize the amount of support provided, by adjusting the tension on the strap. As seen in FIG. 7, the second fastener 9 comprises hook and loop fastener. However, the second fastener 9 may comprise any other size, shape, fastening techniques, location etc. that are known to one of ordinary skill in the art, as long as the intents of the present invention are not altered.

Figure 6:
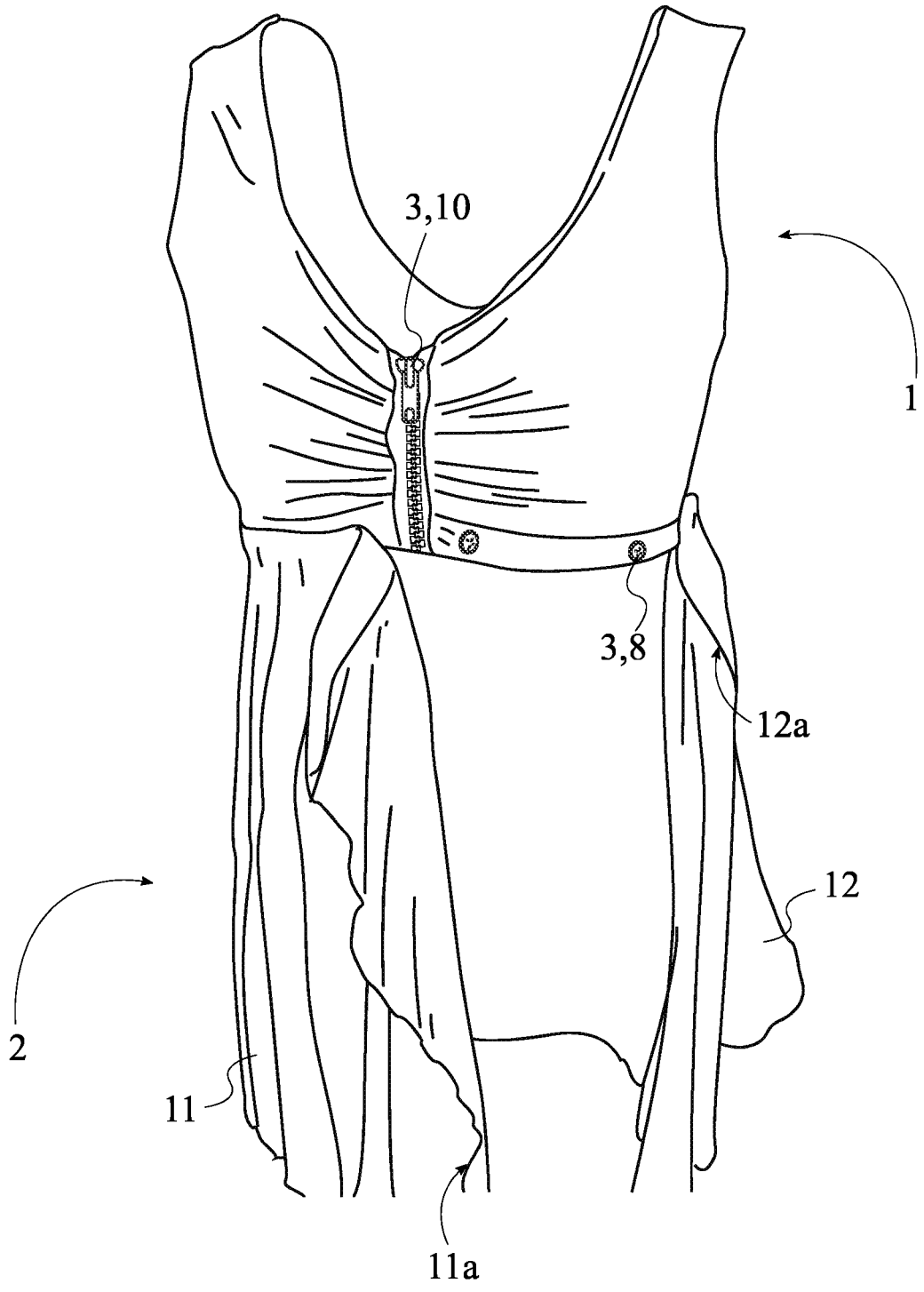
FIG. 6 is a top front perspective view of the present invention, wherein the second piece is partially detached from the first piece.

A front-zipped comfort bra that opens easily using a complete-release zipper while the patient is lying down, facilitates skin-to-skin contact with a newborn immediately after delivery. To accomplish this, the third fastener 10 is integrated centrally along a length 6*a* of the bodice 6. Accordingly, by completely unfastening the third fastener 10, the bodice 6 may be detached into two sections. In other words, wherein the third fastener 10 is unfastened, the third fastener 10 detaches the bodice 6 centrally along a longitudinal axis 10*a*. As clearly seen in FIG. 5, the third fastener 10 is a zipper in the preferred embodiment, but any other fastener, and location that does not hinder with the intents of the present invention may be used for the third fastener 10. Further, as seen in FIG. 1 and FIG. 5, and FIG. 6, a ruched or gathered design at the zipper point creates a flattering style to the garment.

Figure 9:
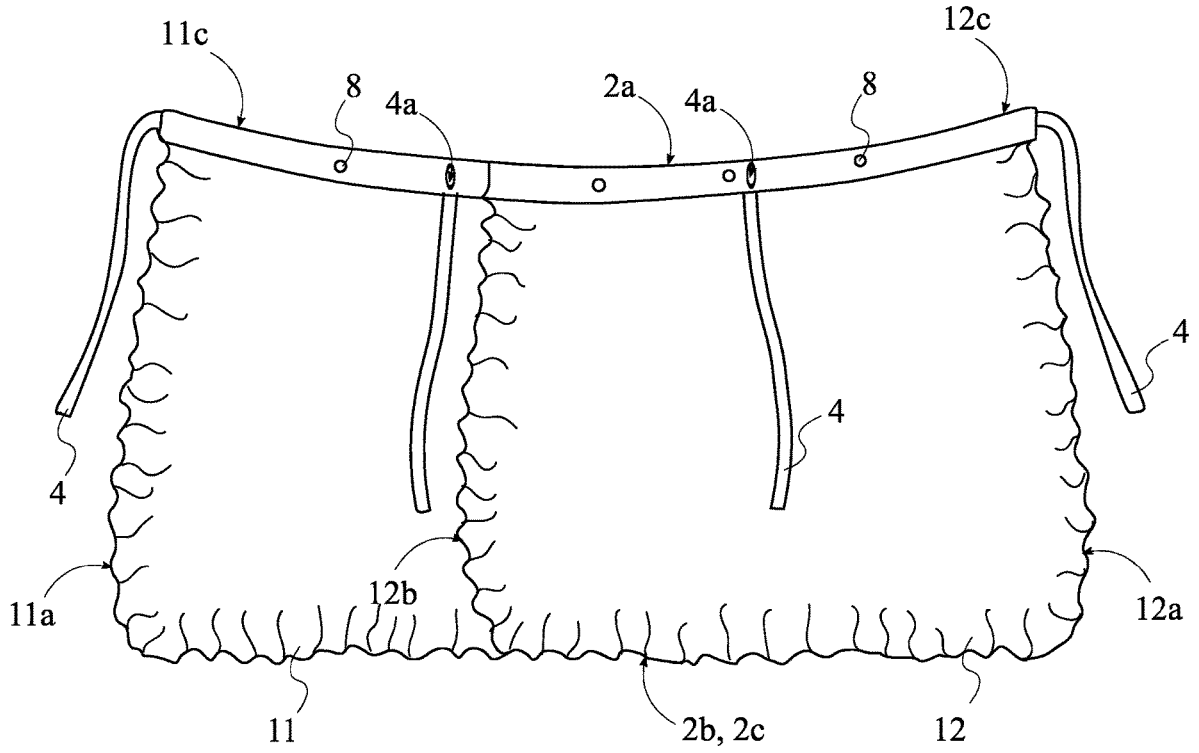
FIG. 9 is a front perspective view of the second piece in an expanded configuration.

According to the present invention, the bottom portion or the second piece 2 may be removed outright from the first piece 1 or transformed into a sarong-style skirt. In some embodiments, this may allow the entire lower half of the outfit to detach from the bodice 6 using color-coded snaps. In other words, the present invention can be worn in two separate pieces, independent of the bodice 6 or lower wrap. To that end, the second piece 2 of the present invention has the plurality of strings 4 being attached along the first end 2*a* of the second piece 2. In other words, the bottom portion can include ties or straps, and the plurality of overlapping panels 7 of the second piece 2 can transform into a sarong skirt. Further, in this configuration, the abdomen may be exposed but the first piece 1 and the second piece 2 provide coverage on the top and bottom portions of the patient. Further, the plurality of strings 4 may allow adjustment to provide a custom fit for individual wearers. To accomplish this, the present invention comprises a plurality of eyelet openings 4*a* traversing through the second piece 2. As seen in FIG. 9, the plurality of eyelet openings 4*a* traverses through the second piece 2, adjacent the second end 2*a*. This is so that, after wrapping the second piece 2 around the user, the user may feed the plurality of strings 4 through the plurality of eyelet openings 4*a* and enable a comfortable custom fit. traves It should be noted that the plurality of strings 4 may comprise any size, shape, material etc., that are known to one of ordinary skill in the art, as long as the objectives of the present invention are fulfilled.

As previously described, the second piece 2 is designed to cover the lower portion of the patient's body from the waist down and includes the plurality of panels (wrap flaps) with a front panel and a back panel. Accordingly, the plurality of overlapping panels 7 extends from the second end 2*b* towards the first end 2*a*, wherein the first end 2*a* is positioned opposite to the second end 2*b* across the second piece 2. More specifically, the plurality of overlapping panels 7 comprises a first panel 11 and a second panel 12. As seen in FIG. 6, FIG. 7 and FIG. 9, the first panel 11 comprises a first lateral edge 11*a* and a second lateral edge 11*b*, wherein the first lateral edge 11*a* is positioned opposite to the second lateral edge 11*b* across a width of the first panel 11. Further, the second panel 12 comprises a third lateral edge 12*a* and a fourth lateral edge 12*b*, wherein the third lateral edge 12*a* is positioned opposite to the fourth lateral edge 12*b* across a width of the second panel 12. In reference to FIG. 6, the first lateral edge 11*a* of the first panel 11*a* and the third lateral edge 12*a* of the second panel 12 together creates a first overlap 7*a*. Similarly, as seen in FIG. 7, the second lateral edge 11*b* of the first panel 11 and the fourth lateral edge 12*b* of the second panel 12 together creates a second overlap 7*b*. Thus, the first panel 11 and the second panel 12 together create the second piece 2 or bottom portion of the garment. In other words, as seen in FIG. 9, a first terminal edge 11*c* of the first panel 11 and a second terminal edge 12*c* of the second panel 12 together delineate the first end 2*a* of the second piece 2.

According to the preferred embodiment, wherein the second piece 2 is in a wrapped configuration, the first end 2*a* is configured into a circular pattern. In other words, when the second piece 2 is worn on a user, the first overlap 7*a* is positioned opposite to the second overlap 7*b*, across the second piece 2, and the plurality of strings 4 may be tied between each other, around the user. Alternately, in reference to FIG. 9 and wherein the second piece 2 is in an expanded configuration, or not used around the user, the first lateral edge 11*a* is positioned away from the third lateral edge 12*a*, thereby disengaging the first overlap 7*a*. In this configuration, the first end 2*a* may be extended along a straight line, and the plurality of strings 4 is untied, as seen in FIG. 9.

The bottom portion with the wraps may be used later as a nursing cover, car seat cover, or diaper changing pad if the mother desires, continuing its usefulness after labor and delivery.

In one embodiment, if only the first piece 1 is worn, the mother may enter a bathtub wearing only a bra for modesty's sake. In another embodiment, the detachable second piece 2 may allow complete access to the patient's lower spine during epidural administration while keeping the chest covered for modesty's sake, and the bottom portion can be converted to a skirt that may be worn during epidural administration. For comfort, the detachable second piece 2 may allow the mother to remove all coverings from her abdomen while maintaining chest coverage using the first piece 1 and the lower body coverage using the second piece 2. In reference to FIG. 3, FIG. 4, and FIG. 8, wherein the present invention is in a detached mode, the first fastener 8 is unfastened, and the first piece 1 is detached from the second piece 2.

Figure 2:
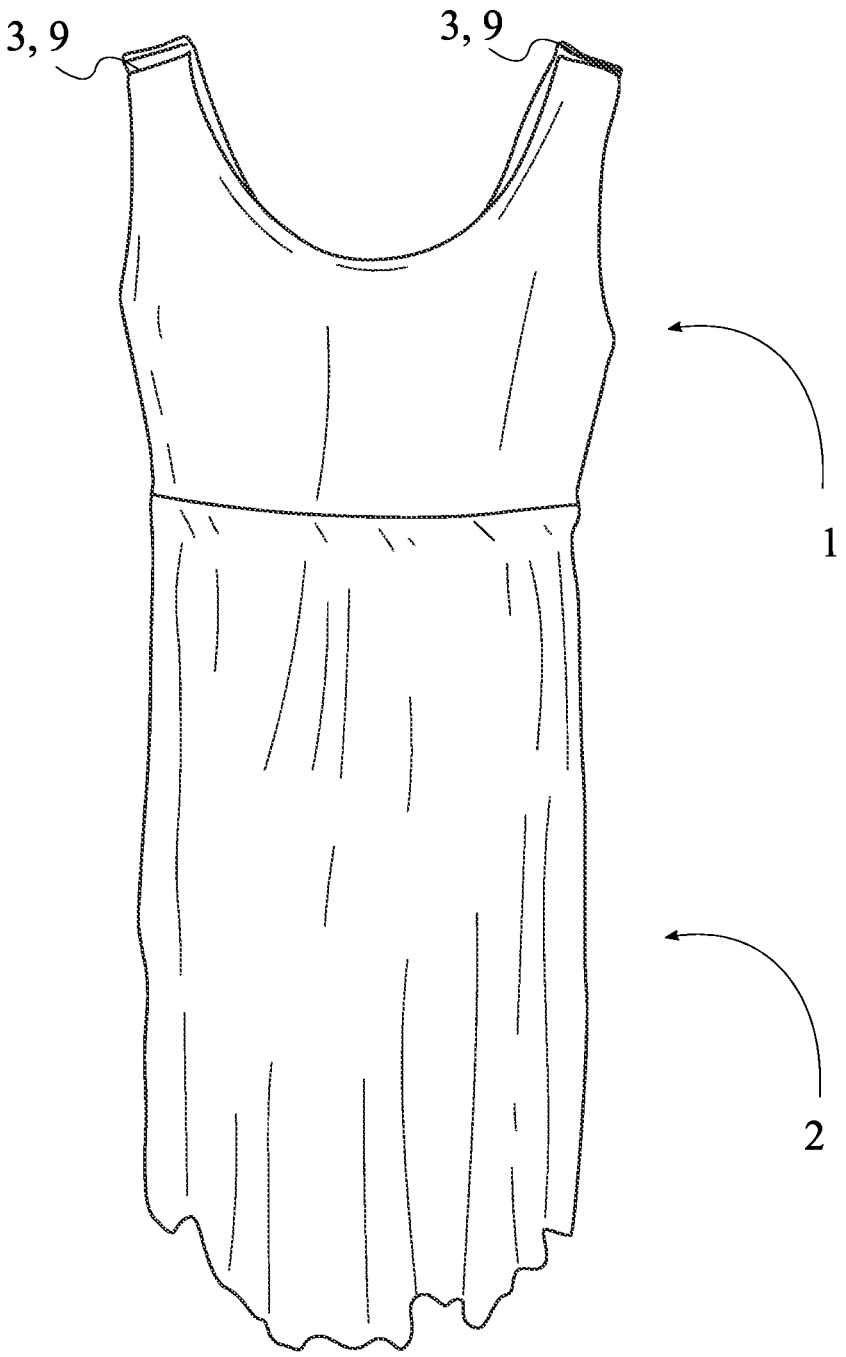
FIG. 2 is a rear elevational view of the present invention.
Figure 3:
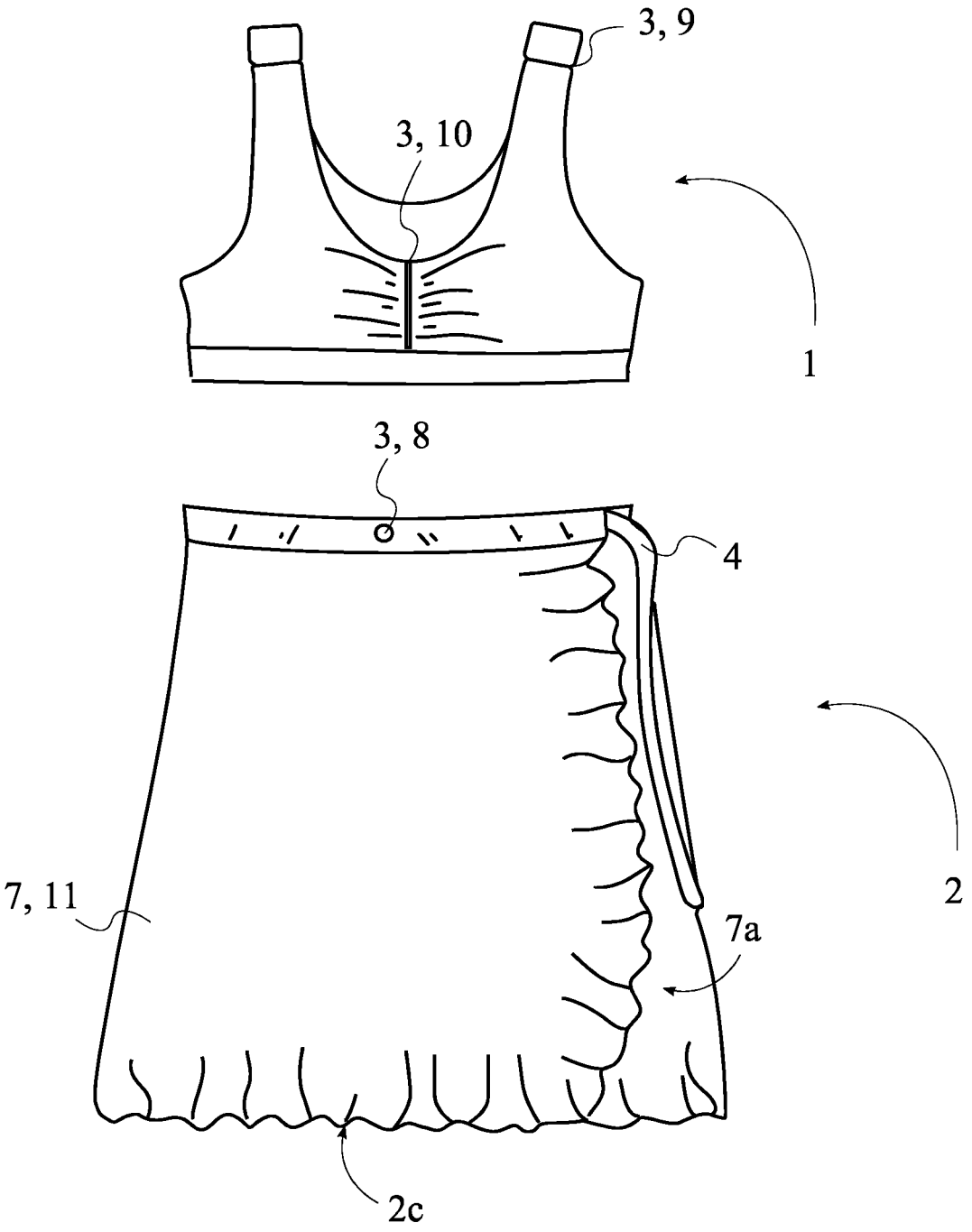
FIG. 3 is a front elevational view of the present invention, wherein a first piece is separated from a second piece.
Figure 4:
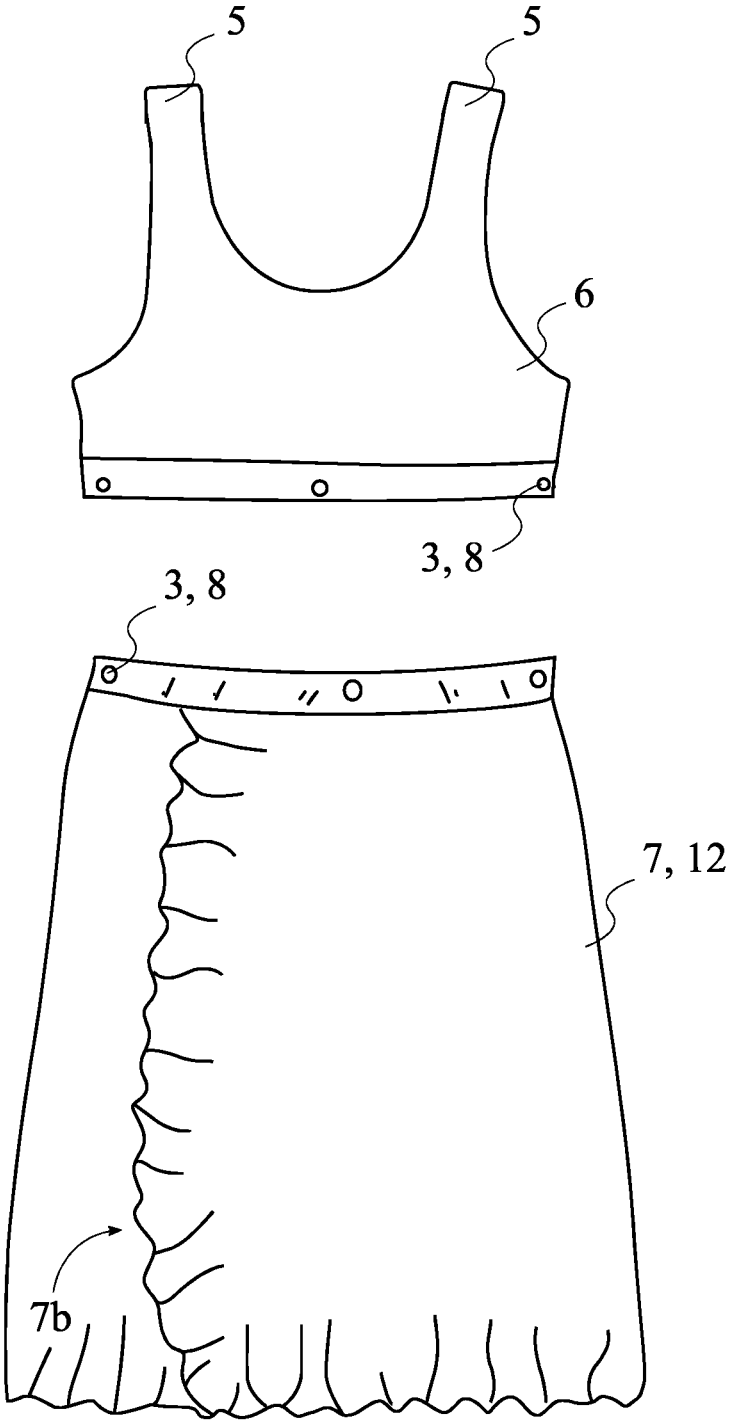
FIG. 4 is a rear elevational view of the present invention, wherein the first piece is separated from the second piece.

Accordingly, the present invention may be quickly and easily removed entirely as needed without slipping it over the head or down the legs for removal. Furthermore, the present invention may be worn for an extended period postpartum while continuing its usefulness, a feature that separates it from other custom labor gowns on the market. In that case, and as seen in FIG. 1 and FIG. 2, wherein the present invention is in a gown mode, the first fastener 8 is fastened, and the first piece 1 is connected to the second piece 2.

The present invention bolsters the mother's autonomy, confidence, and self-esteem through personalized sizing, flattering design, fabric customization, and attention to modesty. To that end, terminal edges 2*c* of the second piece 2 are ruffled, for elevating the dress design and for aesthetic appeal. The present invention further facilitates active movement and position changes while providing ready access for monitoring and medical intervention as needed. As a result, mothers can stay actively involved in their labor and the process can be made more athletic and effective, promoting favorable outcomes for mothers and physicians alike.

Although the invention has been explained in relation to its preferred embodiment, it is to be understood that many other possible modifications and variations can be made without departing from the spirit and scope of the invention as hereinafter claimed.

What is claimed is:

1. A gown, comprising:

a first piece and a second piece, the first piece detachably connected to the second piece along a first end of the second piece, the first piece comprising a bodice having shoulder straps, the second piece comprising a plurality of overlapping panels, wherein the first end of the second piece oppositely disposed to a second end of the second piece;

a plurality of fasteners, comprising:

a first fastener detachably connecting the first piece to the second piece along the first end of the second piece;

a second fastener detachably connecting a front strap to a back strap of each of the shoulder straps;

a third fastener disposed along a central longitudinal axis detachably connecting a left side and a right side of the bodice; and a plurality of strings, the plurality of strings further comprising a set of four strings configured to be strung through a plurality of eyelet openings disposed along the first end of the second piece;

the plurality of eyelet openings configured for receiving the set of four strings, the set of four strings comprising a first, second, third, and fourth string, wherein the first, second, third, and fourth string each have two terminal ends on opposite furthermost tips, wherein a first terminal end of the two terminal ends of each string within the set of four strings are connected to the second piece, and wherein a second terminal end of the two terminal ends of the first string is configured to tie to a second terminal end of the two terminal ends of the second string; and further wherein the second terminal end of the two terminal ends of the first string is configured to tie crosswise to a second terminal end of the two terminal ends of the third string, and the second terminal end of the two terminal ends of the second string is configured to tie crosswise to a second terminal end of the two terminal ends of the fourth string; and each string within the set of four strings traverses through the second piece along the first end of the second piece by way of the plurality of eyelet openings;

the second piece is selected from a group consisting of: nursing cover, car seat cover, and diaper changing pad.

2. The gown of claim 1, wherein the plurality of overlapping panels comprising:

a first panel and a second panel;

the first panel comprising a first lateral edge and a second lateral edge, wherein the first lateral edge oppositely disposed to the second lateral edge with the first panel therebetween;

the second panel comprising a third lateral edge and a fourth lateral edge, wherein the third lateral edge oppositely disposed to the fourth lateral edge with the second panel therebetween;

the first lateral edge of the first panel and the third lateral edge of the second panel together forming a first overlap; and the second lateral edge of the first panel and the fourth lateral edge of the second panel together forming a second overlap.

3. The gown of claim 2, wherein a first terminal edge of the first panel and a second terminal edge of the second panel together forming the first end of the second piece.

4. The gown of claim 2, wherein the second piece further comprising:

the first end shaped into a circular pattern;

the first overlap oppositely disposed to the second overlap, with the second piece therebetween.

5. The gown of claim 2, wherein the second piece further comprising:

the first lateral edge extending away from the third lateral edge, thereby disengaging the first overlap;

the first end of the second piece extending laterally; and the set of four strings configured to be untied from one another.

6. The gown of claim 1, wherein the first, second, and third fasteners are selected from a group consisting of: a zipper, a hook and loop, a hook, a snap, a snap button, and a button, or a combination thereof.

7. The gown of claim 1, wherein when worn, the second piece fastenably attaches to the first piece.

8. The gown of claim 1, wherein when worn, the second piece fastenably detaches to the first piece.

9. The gown of claim 1, wherein terminal edges of the second piece are ruffled.

10. A gown, comprising:

a first piece and a second piece, the first piece detachably connected to the second piece along a first end of the second piece, the first piece comprising a bodice having shoulder straps, the second piece comprising a plurality of overlapping panels, wherein the first end of the second piece is oppositely disposed to a second end of the second piece;

a plurality of fasteners, comprising:

a first fastener detachably connecting the first piece to the second piece along the first end of the second piece;

a second fastener detachably connecting a front strap to a back strap of each of the shoulder straps;

a third fastener disposed along a central longitudinal axis detachably connecting a left side and a right side of the bodice;

a plurality of strings, the plurality of strings further comprising a set of four strings configured to be strung through a plurality of eyelet openings disposed along the first end of the second piece;

the plurality of eyelet openings configured for receiving the set of four strings, the set of four strings comprising a first, second, third, and fourth string, wherein the first, second, third, and fourth string each have two terminal ends on opposite furthermost tips, wherein a first terminal end of the two terminal ends of each string within the set of four strings are connected to the second piece, and wherein a second terminal end of the two terminal ends of the first string is configured to tie to a second terminal end of the two terminal ends of the second string; and further wherein the second terminal end of the two terminal ends of the first string is configured to tie crosswise to a second terminal end of the two terminal ends of the third string, and the second terminal end of the two terminal ends of the second string is configured to tie crosswise to a second terminal end of the two terminal ends of the fourth string; and each string within the set of four strings traverses through the second piece along the first end of the second piece by way of the plurality of eyelet openings;

the second piece is selected from a group consisting of: nursing cover, car seat cover, and diaper changing pad;

wherein the plurality of overlapping panels comprising:

a first panel and a second panel;

the first panel comprising a first lateral edge and a second lateral edge, wherein the first lateral edge oppositely disposed to the second lateral edge with the first panel therebetween;

the second panel comprising a third lateral edge and a fourth lateral edge, wherein the third lateral edge oppositely disposed to the fourth lateral edge with the second panel therebetween;

the first lateral edge of the first panel and the third lateral edge of the second panel together forming a first overlap; and the second lateral edge of the first panel and the fourth lateral edge of the second panel together forming a second overlap, wherein a first terminal edge of the first panel and a second terminal edge of the second panel together forming the first end of the second piece.

11. The gown of claim 10, wherein the second piece further comprising:

the first end shaped into a circular pattern;

the first overlap oppositely disposed to the second overlap, with the second piece therebetween.

12. The gown of claim 10, wherein the second piece further comprising:

the first lateral edge extending away from the third lateral edge, thereby disengaging the first overlap;

the first end of the second piece extending laterally; and the set of four strings configured to be untied from one another.

13. The gown of claim 10, wherein when worn, the second piece fastenably attaches to the first piece.

14. The gown of claim 10, wherein when worn, the second piece fastenably detaches to the first piece.

* * * * *